US007179060B2

(12) United States Patent
Sommars et al.

(10) Patent No.: US 7,179,060 B2
(45) Date of Patent: Feb. 20, 2007

(54) VARIABLE DISCHARGE PUMP WITH TWO PUMPING PLUNGERS AND SHARED SHUTTLE MEMBER

(75) Inventors: Mark F. Sommars, Sparland, IL (US); Dennis H. Gibson, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 378 days.

(21) Appl. No.: 10/314,879

(22) Filed: Dec. 9, 2002

(65) Prior Publication Data

US 2004/0109768 A1 Jun. 10, 2004

(51) Int. Cl.
*F04B 49/22* (2006.01)
*F02M 57/02* (2006.01)

(52) U.S. Cl. ..... 417/53; 417/307; 417/440; 123/446; 123/506

(58) Field of Classification Search ..... 417/307, 417/440, 533, 53; 123/506, 446
See application file for complete search history.

(56) References Cited

U.S. PATENT DOCUMENTS

| | | | | | |
|---|---|---|---|---|---|
| 6,596 | A * | 7/1849 | Thatcher | 417/533 |
| 308,509 | A * | 11/1884 | Mcleod | 417/533 |
| 1,096,463 | A * | 5/1914 | Schorn | 417/531 |
| 1,199,957 | A * | 10/1916 | Wise | 417/533 |
| 3,788,780 | A * | 1/1974 | Chomczyk et al. | 417/493 |
| 4,459,963 | A * | 7/1984 | Gross et al. | 123/506 |
| 4,497,299 | A * | 2/1985 | Schechter | 123/451 |
| 4,583,509 | A * | 4/1986 | Schechter et al. | 123/451 |
| 4,905,960 | A | 3/1990 | Barnhart et al. | |
| 5,094,216 | A * | 3/1992 | Miyaki et al. | 123/506 |
| 5,133,645 | A | 7/1992 | Crowley et al. | |
| 5,207,177 | A * | 5/1993 | Lidman | 119/14.28 |
| 5,404,855 | A * | 4/1995 | Yen et al. | 123/446 |
| 5,538,403 | A | 7/1996 | Black | |
| 6,224,350 | B1 | 5/2001 | Guentert et al. | |
| 6,755,625 | B2 * | 6/2004 | Breeden | 417/298 |

FOREIGN PATENT DOCUMENTS

| | | |
|---|---|---|
| DE | 10036773 | 2/2002 |
| EP | 0 516 196 B1 | 2/1992 |
| EP | 1251272 | 10/2002 |
| EP | 1253313 | 10/2002 |
| EP | 1350948 | 10/2003 |

* cited by examiner

*Primary Examiner*—Charles G. Freay
(74) *Attorney, Agent, or Firm*—Liell + McNeil

(57) ABSTRACT

The present invention relates generally to variable discharge pumps, and specifically pumps used in fuel injection systems. Typically, such pumps include a dedicated spill control valve for each pumping plunger, that also doubles as an avenue for refilling the pumping chambers. This double duty results in compromise in the design of the spill control valve to operate effectively in both spill and fill modes. The present invention addresses these issues by utilizing a shuttle valve member to allow the spill function and the fill function to be addressed in separate passageways while also allowing a pair of plungers to share a common spill control valve. The present invention find particular application in pumps used to supply high pressure fluid to common rails for fuel injection systems.

8 Claims, 5 Drawing Sheets

VARIABLE DISCHARGE PUMP WITH TWO PUMPING PLUNGERS AND SHARED SHUTTLE MEMBER

TECHNICAL FIELD

The present invention relates generally to variable discharge pumps, and more particularly to variable discharge pumps having a pair of pumping plungers.

BACKGROUND

In one class of fluid systems, such as common rail fuel systems for internal combustion engines, a variable discharge pump is utilized to maintain a pressurized fluid supply for a plurality of fuel injectors. For instance, European Patent Specification EP 0,516,196 teaches a variable discharge high pressure pump for use in a common rail fuel injection system. The pump maintains the common rail at a desired pressure by controllably displacing fluid from the pump to either the high pressure common rail or toward a low pressure reservoir with each pumping stroke of each pump piston. This is accomplished by associating an electronically controlled spill valve with each pump piston. When the pump piston is undergoing its pumping stroke, the fluid displaced is initially pushed into a low pressure reservoir past a spill control valve. When the spill control valve is energized, it closes the spill passageway causing fluid in the pumping chamber to quickly rise in pressure. The fluid in the pumping chamber is then pushed past a check valve into a high pressure line connected to the common rail. In this type of system, the pump typically includes several pump pistons or the system is maintained with several individual unit pumps. The various pump pistons are preferably out of phase with one another so that at least one piston is pumping at about the same time one of the hydraulic devices is consuming fluid from the common rail. This strategy allows the pressure in the common rail to be more steadily controlled in a highly dynamic environment.

As stated, in the pump of the above identified patent, fluid is initially displaced from each pump chamber through a spill control valve toward a low pressure reservoir when the individual pump pistons begin their pumping stroke. When the spill control valve is energized, this spill passageway is closed allowing fluid pressure to build and be pushed past a check valve toward the high pressure common rail. Like many pumps of its type, the spill control valve is a pressure latching type valve in which the valve member is held in its closed position via fluid pressure so that the actuator can be deenergized after the spill control valve has been closed, which can conserve electrical energy. In other words, the fluid pressure in the pumping chamber itself holds the spill control valve closed until that pressure drops toward the end of the pumping stroke, where a spring or other bias pushes the spill control valve back to its open position. When the pump piston undergoes its retracting stroke, fresh fluid is drawn into the pumping chamber past the spill control valve. Thus, the identified patent teaches a spill control valve that both fills the pump cavity with inlet fluid and spills the pump cavity during the time preceding the closing of the valve and the commencement of pump discharge toward the high pressure common rail.

One problem associated with pumps of the type previously described is that the process of filling the pumping chamber and that of spilling the pumping chamber before high pressure pumping begins tend to conflict with one another. Optimizing the spill control valve details for spilling requires designing the valve and valve body geometry to, among other things, avoid shutting the valve due to flow forces before the electrical actuator is energized. This design criteria often conflicts with the need to fill the pumping chamber through the same fluid circuit. Thus, the pump previously described suffers from two potential drawbacks in that a separate spill control valve is needed for each pumping plunger, and each pump cavity both fills and spills through the spill control valve, resulting in design compromises to efficiently achieve both effective spilling and filling.

The present invention is directed to overcoming one or more of the problems set forth above.

SUMMARY OF THE INVENTION

In one aspect, a pump includes first and second plungers positioned to reciprocate in first and second pumping chambers of first and second barrels, respectively. At least one spill passage is fluidly connected to the first and second pumping chambers. A spill control valve is fluidly connected to at least one spill passage. At least one supply passage is fluidly connected to the first and second pumping chambers but fluidly disconnected from the spill control valve.

In another aspect, a pump includes a first barrel with a first pumping chamber and a second barrel with a second pumping chamber. A first plunger is positioned to reciprocate in the first barrel, and a second plunger is positioned to reciprocate in the second barrel out of phase with the first plunger. A shuttle member has a first hydraulic surface exposed to fluid pressure in the first pumping chamber, and a second hydraulic surface oriented in opposition to the first hydraulic surface and exposed to fluid pressure in the second pumping chamber.

In still another aspect, a method of operating a pump includes a step of reciprocating a pair of plungers out of phase with one another in respective first and second pumping chambers. Fluid is supplied to the first and second pumping chambers via at least one supply passage. Fluid is spilled from the first and second pumping chambers via at least one spill passage.

DETAILED DESCRIPTION

Figure 1:
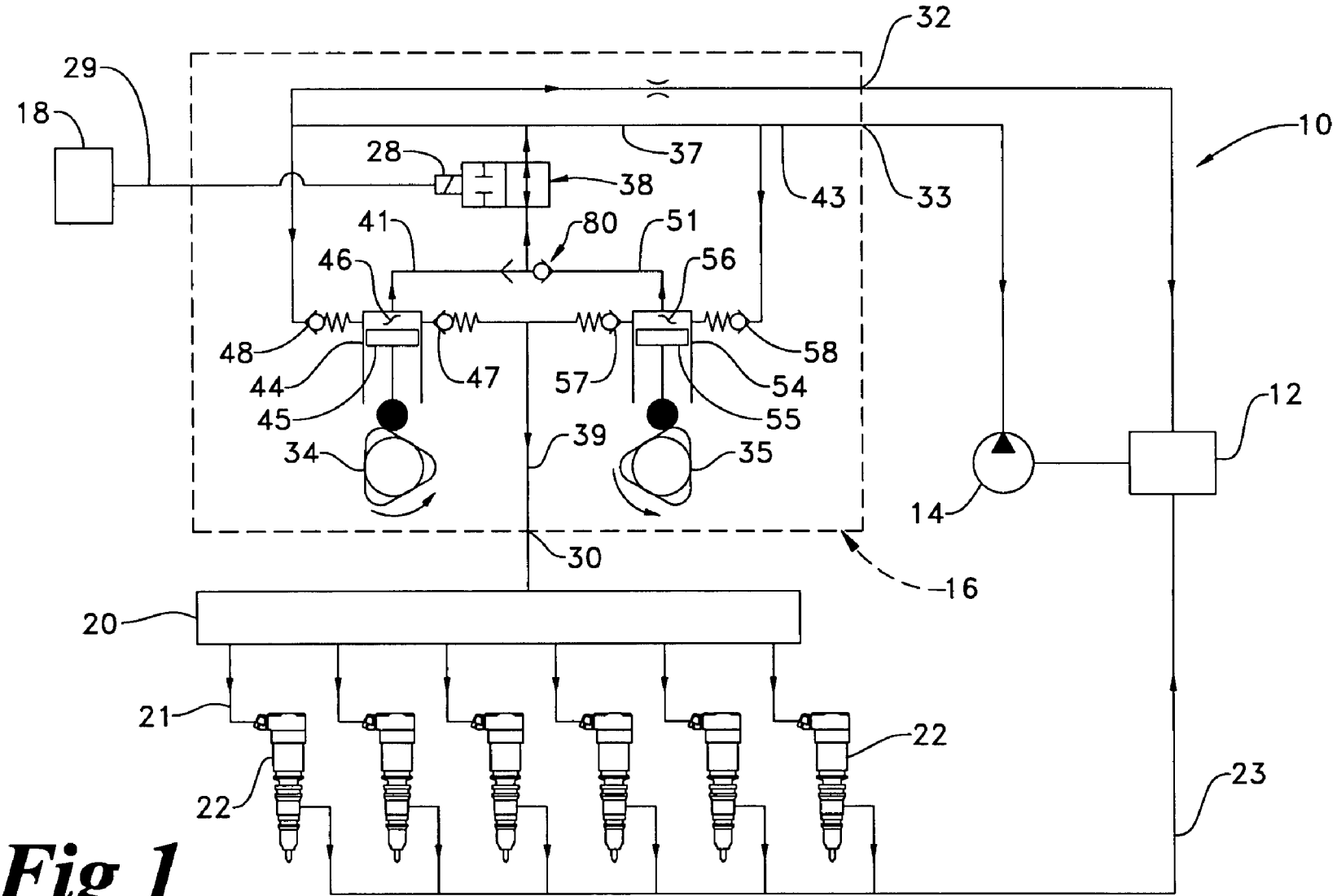
FIG. 1 is a schematic illustration of a common rail fuel system according to one aspect of the present invention.

Referring to FIG. 1, a fuel system 10 includes a plurality of fuel injectors 22, which are each connected to a high pressure fuel rail 20 via an individual branch passage 21. The high pressure fuel rail 20 is supplied with high pressure fuel from a high pressure pump 16, which is supplied with relatively low pressure fluid by a fuel transfer pump 14. Fuel transfer pump 14 draws fuel from a fuel tank 12, which is also fluidly connected to the fuel injectors 22 via a leak return passage 23. Fuel system 10 is controlled in its operation in a conventional manner via an electronic control module 18 which is connected to an electrical actuator 28 of pump 16 via a control communication line 29, and connected to the individual fuel injectors 22 via other communication lines (not shown). When in operation, control signals generated by electronic control module 18 determine when and how much fuel displaced by pump 16 is forced into common rail 20, as well as when and for what duration (fuel injection quantity) that fuel injectors 22 operate.

Figure 2:
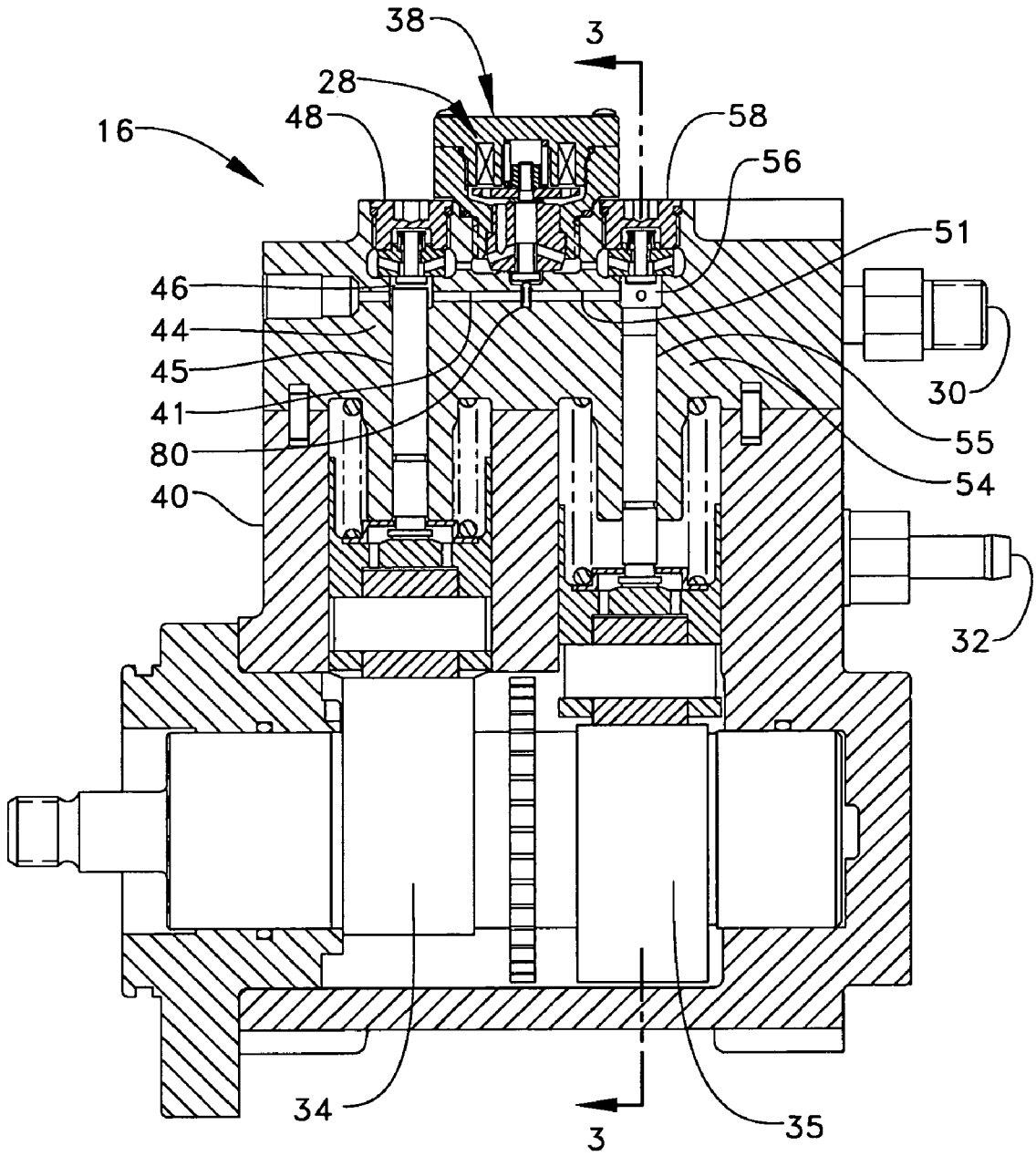
FIG. 2 is a front sectioned view of a pump from the fuel system shown in FIG. 1.
Figure 3:
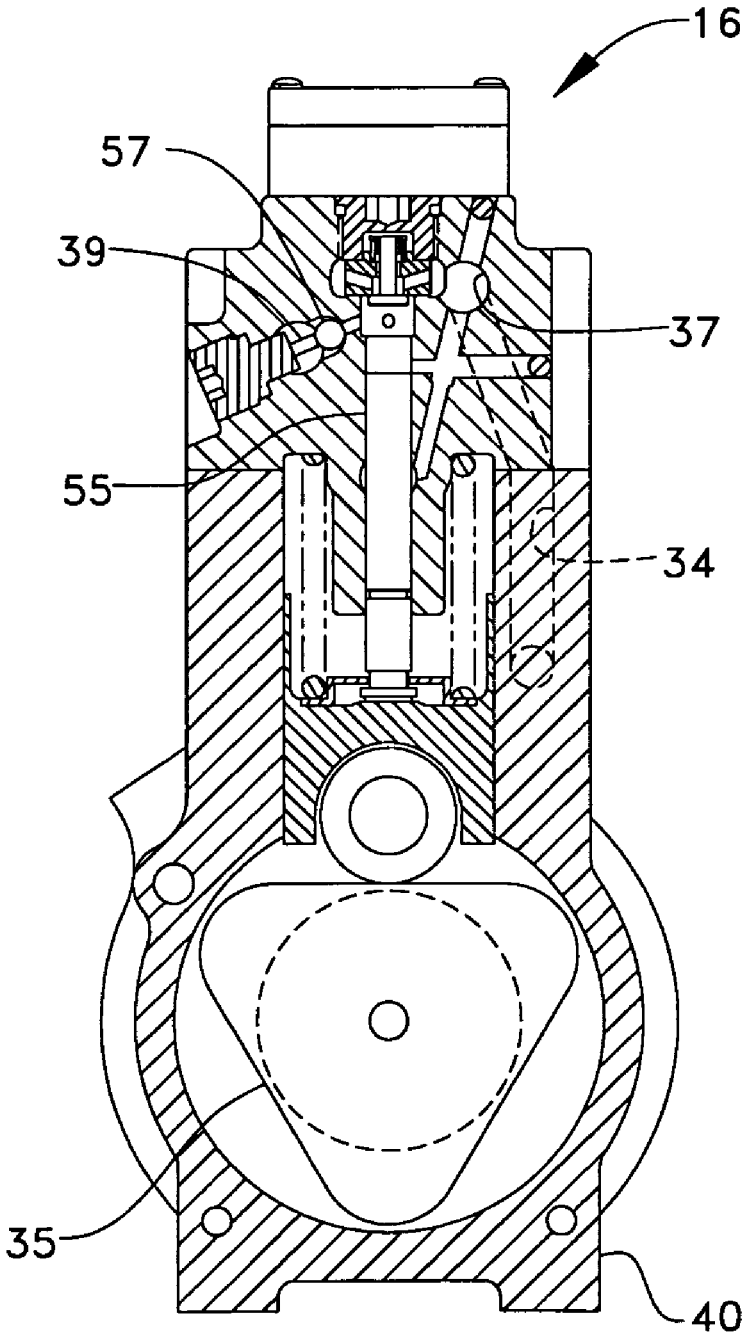
FIG. 3 is a side sectioned view of the pump of FIG. 2.

Referring in addition to FIGS. 2 and 3, high pressure pump 16 includes a high pressure outlet 30 fluidly connected to the high pressure rail 20, a low pressure outlet 32 connected to fuel tank 12, and an inlet 33 fluidly connected to fuel transfer pump 14. Pump 16 also includes a first plunger 45 positioned to reciprocate in a first pumping chamber 46 of a first barrel 44. In addition, pump 16 includes a second plunger 55 positioned to reciprocate in a second pumping chamber 56 of a second barrel 54. Although not necessary, first and second barrels 44, 54 are preferably portions of a common pump housing 40. A pair of cams 34 and 35 are operable to cause plungers 45 and 55 to reciprocate out of phase with one another. In this embodiment, cams 34 and 35 each include three lobes such that one of the plungers 45 or 55 is undergoing a pumping stroke at about the time that one of the fuel injectors 22 is injecting fuel. Thus, cams 34 and 35 are preferably driven to rotate directly by the engine at a rate that preferably synchronizes pumping activity to fuel injection activity in a conventional manner.

When plunger 45 is undergoing its retracting stroke, fresh low pressure fuel is drawn into pumping chamber 46 past a first inlet check valve 48 from a low pressure gallery 37 that is fluidly connected to inlet 33. Likewise, when plunger 55 is undergoing its retracting stroke, fresh low pressure fuel is drawn into the second pumping chamber 56 past a second inlet check valve 58 from the shared low pressure gallery 37. When first plunger 45 is undergoing its pumping stroke, fluid is displaced from pumping chamber 46 either into low pressure gallery 37 via first spill passage 41 and spill control valve 38, or into high pressure gallery 39 past first outlet check valve 47. Likewise, when second plunger 55 is undergoing its pumping stroke, fuel is displaced from second pumping chamber 56 either into low pressure gallery 37 via second spill passage 51 and spill control valve 38, or into high pressure gallery 39 past second outlet check valve 57.

Figure 4:
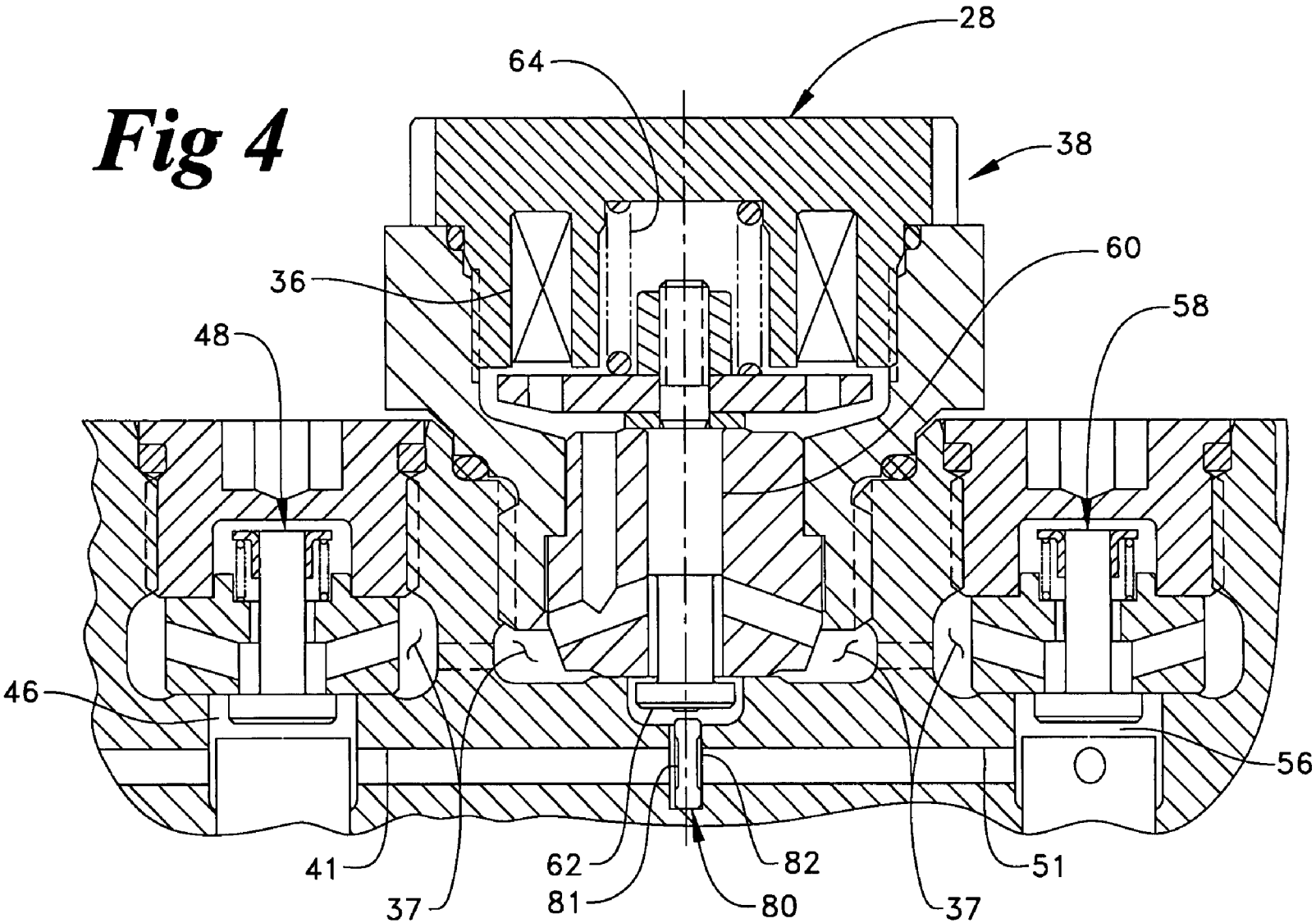
FIG. 4 is an enlarged front sectioned view of the fill and spill portion of the pump of FIGS. 2 and 3.

Referring now in addition to figure 4, only one of the pumping chambers 46 or 56 is fluidly connected to spill control valve 38 at a time. These fluid connections are controlled by a shuttle valve member 80 that includes a first hydraulic surface 81 exposed to fluid pressure in first pumping chamber 46, and a second hydraulic surface 82, which is oriented in opposition to first hydraulic surface 81 and exposed to fluid pressure in second pumping chamber 56. Because pumping plungers 44 and 54 are out of phase with one another, one pumping chamber will be at low pressure (retracting) when the other pumping chamber is at high pressure (advancing), and vice versa. This action is exploited to move shuttle valve member 80 back and forth to connect either first spill passage 41 to spill control valve 38, or fluidly connect second spill passage 51 to spill control valve 38. Thus, first hydraulic surface 81 and second hydraulic surface 82 actually define a portion of first spill passage 41 and second spill passage 51, respectively. This allows pumping chambers 46 and 56 to share a common spill control valve 38. In other words, when first plunger 44 is undergoing its pumping stroke while second plunger 54 is undergoing its retracting stroke, shuttle valve member 80 will be in a position shown in figure 4 in which first pumping chamber 46 is fluidly connected to spill control valve 38. This is caused by hydraulic fluid pressure acting on first hydraulic surface 81 from pumping chamber 44 pushing shuttle valve member 80 to the right to close second spill passage 51. The affect of this is twofold. First, a single spill control valve 38 can be used to control high pressure discharge from two separate pumping chambers. And second, second pumping chamber 56 is refilled past a second inlet check valve 58 rather than past the spill control valve as in the prior art. These features allow the spill control valve 38 to be optimized for flow in one direction, namely in the spill direction without requiring it to also perform the duty of reverse flow to fill a pumping chamber(s). In addition, this strategy also allows for the usage of a simple cartridge check valve 58 for controlling low pressure fill into the second pumping chamber 56. When second plunger 54 is undergoing its pumping stroke and first plunger 44 is undergoing its retracting stroke, shuttle valve member 80 moves to the left to connect second spill passage 51 to spill control valve 38, while low pressure fuel refills first pumping chamber 46 past first inlet check valve 48.

Spill control valve 38 has a structure that shares many features in common with known valves of its type. For instance, it includes a spill valve member 60 that includes a closing hydraulic surface 62 that produces a latching affect when valve member 60 is in contact with valve seat 63. Spill valve member 60 is normally biased downward toward its open position, as shown in FIG. 4, via a biasing spring 64. However, spill valve member 60 can be moved upward to close valve seat 63 by energizing electrical actuator 28. In the illustrated embodiment, electrical actuator 28 is a solenoid that includes an armature 36 attached to move with spill valve member 60. Nevertheless, those skilled in the art will appreciate that electrical actuator 28 could take a variety of forms, including but not limited to piezo and/or piezo bender actuators. In the illustrated embodiment, electrical actuator 28 controls the output from a pair of pumping chambers.

Figure 5:
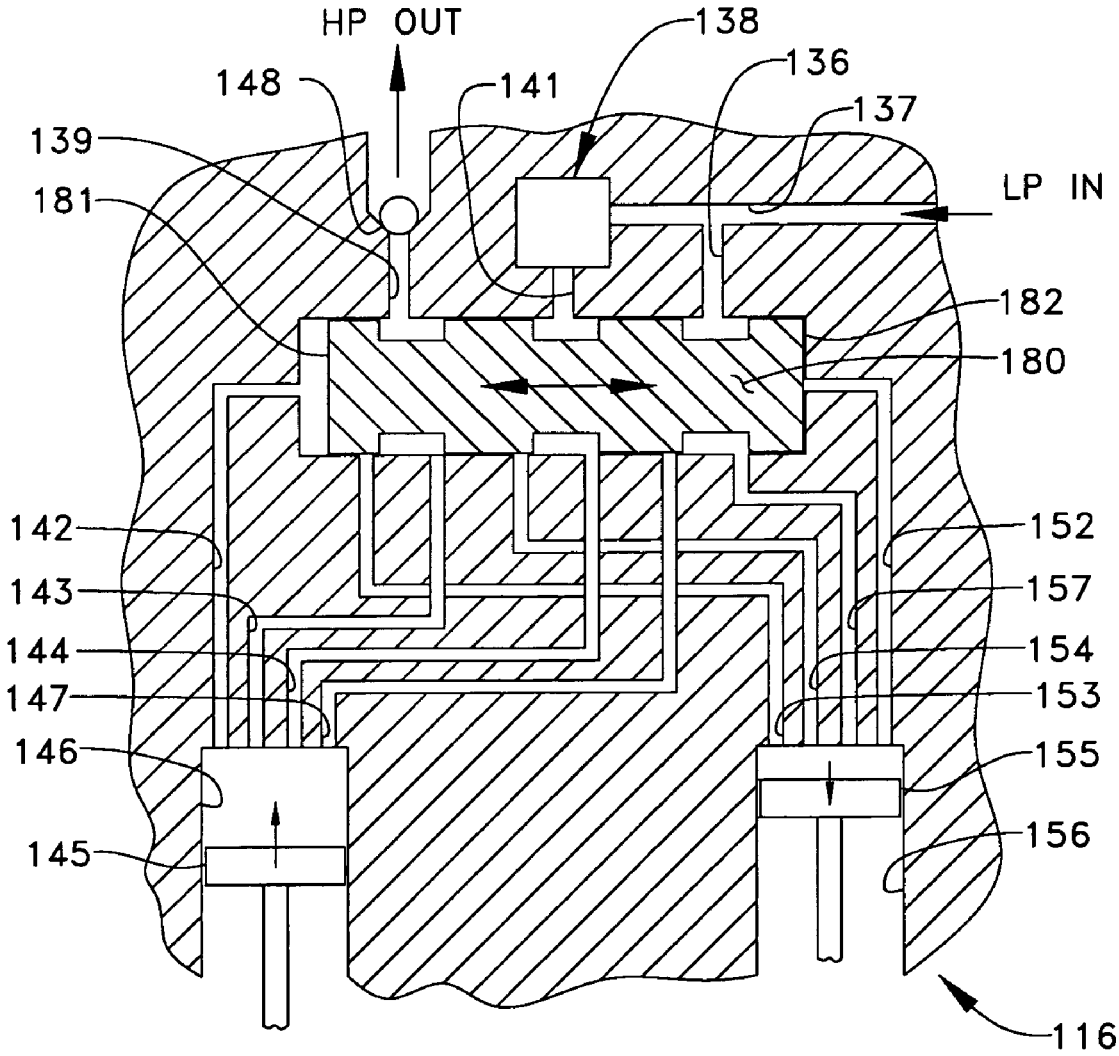
FIG. 5 is a schematic illustration of a pump according to another embodiment of the present invention.

Referring now to FIG. 5, a schematic illustration of a high pressure pump 116 according to another embodiment of the present invention is similar to the previous embodiment in that it includes a shuttle valve member 180 that permits the sharing of a single spill control valve 138 between a pair of pumping plungers 145 and 155. This embodiment differs from the earlier embodiment in that no inlet check valves are needed, and the two pumping chambers 146 and 156 share a common outlet check valve 148. When first plunger 145 is undergoing its pumping stroke and second plunger 155 is undergoing its retracting stroke, as shown, the pressure differentials produced in respective pumping chambers 146 and 156 cause shuttle valve member 180 to move to the right to the position shown. This is caused by an increase of fluid pressure acting on first hydraulic surface 181 via a first pressure communication passage 42 while a lower pressure force is acting on second hydraulic surface 182 via a second pressure communication passage 152. When shuttle valve member 180 is in the position shown, first pumping chamber 146 is fluidly connected to outlet gallery 139 via first outlet passage 143. In addition, first pumping chamber 146 is also fluidly connected to spill control valve 138 via first spill passage 144 and common spill passage 141. Finally, first pumping chamber 146 is fluidly disconnected from low pressure gallery 137 and supply passage 136 due to shuttle valve member 180 closing first supply passage 147. Thus, when spill control valve 138 is energized, common spill passage 141 will close and high pressure fluid will be displaced from first pumping chamber 146 past outlet check valve 148.

At the same time that first plunger 145 is undergoing its pumping stroke, second plunger 155 is undergoing its retracting stroke, and fresh low pressure fuel is drawn into second pumping chamber 156 from low pressure gallery 137 via supply passage 136 and second supply passage 157. At the same time shuttle valve member 180 blocks second spill passage 154 and second outlet passage 153. Thus, the spool valve nature of shuttle valve member 180 allows for the elimination of inlet check valves and allows for the sharing of a single outlet check valve as well as the sharing of a single spill control valve between two separate plungers reciprocating out of phase with one another.

INDUSTRIAL APPLICABILITY

The present invention finds potential application in any fluid system where there is a desire to control discharge from a pump. The present invention finds particular applicability in variable discharge pumps used in relation to fuel injection systems, especially common rail fuel injection systems. Nevertheless, those skilled in the art will appreciate that the present invention could be utilized in relation to other hydraulic systems that may or may not be associated with an internal combustion engine. For instance, the present invention could also be utilized in relation to hydraulic systems for internal combustion that use a hydraulic medium, such as engine lubricating oil, to actuate various sub-systems, including but not limited to hydraulically actuated fuel injectors and gas exchange valves, such as engine brakes. A pump according to the present invention could also be substituted for a pair of unit pumps in other fuel systems, including those that do not include a common rail.

Referring to FIG. 1, when fuel system 10 is in operation, cams 34 and 35 rotate causing pump plungers 45 and 55 to reciprocate in respective barrels 44 and 54 out of phase with one another. When first plunger 45 is undergoing its pumping stroke, second plunger 55 will be undergoing its retracting stroke. This action is exploited via shuttle valve member 80 to either connect first pumping chamber 46 or second pumping chamber 56 to spill control valve 38. As one of the plungers begins its pumping stroke, fluid is initially displaced from the pumping chamber through spill control valve 38 to low pressure gallery 37. When there is a desire to output high pressure from the pump, electrical actuator 28 is energized to close spill control valve 38. This causes fluid in the pumping chamber to be pushed past the respective check valve 47 or 57 into high pressure gallery 39 and then into high pressure rail 20. Those skilled in the art will appreciate that the timing at which electrical actuator 28 is energized determines what fraction of the amount of fluid displaced by the plunger action is pushed into the high pressure gallery and what other fraction is displaced back to low pressure gallery 37. This operation serves as a means by which pressure can be maintained and controlled in high pressure rail 20. While one plunger is pumping, the other plunger is retracting drawing low pressure fuel into its pumping chamber past one of the respective inlet check valves 48 or 58. This action allows for the spill control valve 38 to be optimized for flow in one direction, namely in a spill direction. Likewise, the spill action of the pump can be optimized for features known in the art independent of spill control valve 38.

Referring now to FIG. 5, pump 116 operates in much a similar manner as pump 16 described earlier accept that shuttle valve member 180 is a spool valve member that allows for the elimination of inlet check valves and allows for the sharing of a single outlet check valve between the two pumping plungers 145 and 155. Thus, pump 116 works in a virtually identical manner with a more complex shuttle valve member but a lower part count regarding check valves associated with the pump.

Thus, the present invention utilizes one electrical actuator valve combination to control the discharge of two plungers. To facilitate that arrangement, a shuttle valve is located between the plunger pumping cavities and the spill control valve. The pumping action of the first plunger combined with the intake action of the second forces the shuttle valve to a position that blocks fluid entry into the filling plunger while providing an open path between the pumping plunger and the spill control valve. The spill control valve can then be activated at any time between the commencement of the pumping plunger's motion and the end of its motion. Closing the valve initiates a rise in plunger cavity pressure, an opening of the outlet check valve and a start of the delivery of high pressure fuel to the high pressure fuel rail. The increase in pressure holds the shuttle valve shut until the plunger slows and stops at the end of its motion, at which time the solenoid biasing spring opens the spill control valve in preparation for the next plunger's action. As the second plunger switches modes from filling to pumping (and the first plunger switches from pumping to filling), the shuttle valve moves to the other side of its cavity blocking fluid entry into the filling plunger, and opening the path between the pumping plunger and the spill control valve allowing the spill control valve to control the discharge of the second plunger cavity.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

LIST OF ELEMENTS

Title: Variable Discharge Pump

File: Cat 02-326

10. Fuel System
12. Fuel Tank
14. Fuel Transfer Pump
16. High Pressure Pump
18. Electronic Control Module
20. High Pressure Fuel Rail
21. Branch Passage
22. Fuel Injectors
23. Leak Return Passage
28. Electrical Actuator
29. Control Communication Line
30. High Pressure Outlet
32. Low Pressure Outlet
34. Cam
35. Cam
36. Armature
38. Spill Control Valve
39. High Pressure Gallery
40. Pump Housing
41. First Spill Passage
43. Supply Passage
44. First Barrel
45. First Plunger
46. Fist Pumping Chamber
47. First Outlet Check Valve
48. First Inlet Check Valve

51. Second Spill Passage
54. Second Barrel
55. Second Plunger
56. Second Pumping Chamber
57. Second Outlet Check Valve
58. Second Inlet Check Valve
60. Spill Valve Member
62. Closing Hydraulic Surface
63. Valve Seat
64. Biasing Spring
80. Shuttle Valve Member
81. First Hydraulic Surface
82. Second Hydraulic Surface
116. High Pressure Pump
136. Supply Passage
137. Low Pressure Gallery
138. Spill Control Valve
139. Outlet Gallery
141. Common Spill Passage
142. First Pressure Communication Passage
143. First Outlet Passage
144. First Spill Passage
145. First Plunger
146. First Pumping Chamber
147. First Supply Passage
148. Outlet Check Valve
152. Second Pressure Communication Passage
153. Second Outlet Passage
154. Second Spill Passage
155. Second Plunger
156. Second Pumping Chamber
157. Second Supply Passage
180. Shuttle Valve Member
181. First Hydraulic Surface
182. Second Hydraulic Surface

What is claimed is:

1. A pump comprising:

a pump housing including a first barrel including a first pumping chamber, and a second barrel including a second pumping chamber;

a first plunger positioned to reciprocate in said first barrel;

a second plunger positioned to reciprocate in said second barrel out of phase with said first plunger;

first and second cams positioned in said pump housing and being operably coupled to move the first and second plungers, respectively;

first and second inlet check valves fluidly positioned between a low pressure gallery and said first and second pumping chambers, respectively;

a shuttle member having a first hydraulic surface exposed to fluid pressure in said first pumping chamber, and a second hydraulic surface oriented in opposition to said first hydraulic surface and being exposed to fluid pressure in said second pumping chamber;

a spill control valve fluidly positioned between said low pressure gallery and a first and second spill passage, which include a common segment between said shuttle valve member and said spill control valve, and said spill control valve being a latching valve with a latching valve member held in a closed position contacting a seat by fluid pressure in one of said first and second pumping chambers;

said shuttle member being moveable between a first position in which said first pumping chamber is fluidly connected to said spill control valve and a second position in which said second pumping chamber is fluidly connected to said spill control valve;

an electrical actuator operably coupled to said spill control valve, and being operable to move said latching valve member away from said first and second spill passage toward said seat to a closed position when energized; and a spring operably positioned to bias said latching valve member toward said shuttle valve member.

2. The pump of claim 1 wherein said first pumping chamber is fluidly connected to said spill control valve via said first spill passage, which is partially defined by said first hydraulic surface when said shuttle member is in said first position; and said second pumping chamber is fluidly connected to said spill control valve via said second spill passage, which is partially defined by said second hydraulic surface when said shuttle member is in said second position.

3. The pump of claim 1 wherein said first barrel and said second barrel are portions of said housing;

each of said first and second inlet check valves is a cartridge valve attached to said pump housing; and said spill control valve is attached to said housing.

4. The pump of claim 1 wherein said shuttle member is a disk.

5. The pump of claim 1 wherein said first barrel and said second barrel are portions of said housing;

said spill control valve is attached to said housing; and said shuttle member is a disk.

6. A method of operating a pump, comprising the steps of:

reciprocating a pair of plungers out of phase with one another in respective first and second pumping chambers;

supplying fluid to said first and second pumping chambers via respective first and second inlet check valves from a low pressure gallery;

spilling fluid from said first and second pumping chambers to the low pressure gallery via a first and second spill passage, respectively;

sharing a common spill control valve between said first pumping chamber and said second pumping chamber, and said sharing step includes a step of moving a shuttle member between a first position and a second position, and said moving step includes hydraulically pushing the shuttle member; and holding the spill control valve in a closed position with fluid pressure in one of said first and second pumping chambers.

7. The method of claim 6 including a step of controlling pressurized output from said first and second pumping chambers via a single electrical actuator, and the controlling step including a step of moving a valve member of said spill control valve away from said first and second spill passage toward a seat to a closed position by energizing the single electrical actuator.

8. The method of claim 7 including a step of de-energizing the single electrical actuator during a pumping stroke and holding the spill control valve closed with fluid pressure in the pumping chamber that is undergoing said pumping stroke.

* * * * *

UNITED STATES PATENT AND TRADEMARK OFFICE

CERTIFICATE OF CORRECTION

PATENT NO. : 7,179,060 B2
APPLICATION NO. : 10/314879
DATED : February 20, 2007
INVENTOR(S) : Sommars et al.

It is certified that error appears in the above-identified patent and that said Letters Patent is hereby corrected as shown below:

In Column 6, Line 39, delete "Variable Discharge Pump" and insert -- Variable Discharge Pump With Two Pumping Plungers And Shared Shuttle Member --, therefor.

In Column 6, Line 54, below "32. Low Pressure Outlet" insert -- 33. Inlet --.

In Column 6, Line 58, below "36. Armature" insert -- 37. Low Pressure Gallery --.

In Column 6, Line 65, delete "46. Fist Pumping Chamber" and insert -- 46. First Pumping Chamber --, therefor.

Signed and Sealed this

Twenty-fourth Day of June, 2008

JON W. DUDAS
*Director of the United States Patent and Trademark Office*